United States Patent [19]

Iizuka et al.

[11] Patent Number: 4,776,717

[45] Date of Patent: Oct. 11, 1988

[54] CONTAINER TYPE TOILET IMPLEMENT

[75] Inventors: Shigeo Iizuka; Kazuo Suzuki; Tadao Saito, all of Tokyo, Japan

[73] Assignee: Yoshino Kogyosho Co., Ltd., Tokyo, Japan

[21] Appl. No.: 148,121

[22] Filed: Jan. 27, 1988

Related U.S. Application Data

[63] Continuation of Ser. No. 854,763, Apr. 23, 1986.

[30] Foreign Application Priority Data

Apr. 26, 1985 [JP] Japan ..... 60-63571
Nov. 26, 1985 [JP] Japan ..... 60-182319

[51] Int. Cl.[4] ..... A46B 11/02; B05C 1/06

[52] U.S. Cl. ..... 401/176; 401/171; 15/176

[58] Field of Search ..... 401/176, 177, 179, 171, 401/182, 146, 149–151, 194; 132/85, 88.7

[56] References Cited

U.S. PATENT DOCUMENTS

| | | | |
|---|---|---|---|
| 1,207,121 | 12/1916 | Zeidler | 401/150 |
| 2,293,211 | 8/1942 | Mureau | 409/176 |
| 3,167,806 | 2/1965 | Hogan | 132/85 X |
| 3,181,539 | 5/1965 | Aston | 132/85 X |
| 3,351,074 | 11/1967 | Aston . | |
| 3,359,992 | 12/1967 | Cishek et al. | 401/171 X |
| 3,468,612 | 9/1969 | Aston | 132/88.7 X |
| 4,309,119 | 1/1982 | Wittersheim | 401/176 X |

FOREIGN PATENT DOCUMENTS

| | | | |
|---|---|---|---|
| 165657 | 10/1955 | Australia . | |
| 62059/65 | 2/1967 | Australia . | |
| 440628 | 10/1973 | Australia . | |
| 0123518 | 10/1984 | European Pat. Off. | 401/146 |
| 2551636 | 3/1985 | France . | |
| 2630569 | 1/1978 | Fed. Rep. of Germany . | |
| 1562817 | 3/1980 | United Kingdom . | |
| 2150424 | 7/1985 | United Kingdom | 401/171 |

*Primary Examiner*—Dennis L. Taylor
*Attorney, Agent, or Firm*—Parkhurst, Oliff & Berridge

[57] ABSTRACT

A container type toilet implement comprises a container body, a cylinder and piston mechanism projected upwardly from the neck of said body, and a bottom cover elevationally movable at the lower end of the body for operating the cylinder and piston mechanism. An exhaust valve member is provided in the piston and cylinder mechanism. A brush tip retaining shaft is slidably engaged with the cylinder and piston mechanism, a brush tip is mounted at the tip retaining shaft, and inner hollow cylindrical core is disposed in the vicinity of the inner center of the tip for communicating at the lower end with the exhaust valve member. At least the brush tip retaining member is coated on its outer periphery except for the tip end of the brush tip. The container type toilet implement can prevent the liquid lotion from leaking.

8 Claims, 2 Drawing Sheets

CONTAINER TYPE TOILET IMPLEMENT

This is a continuation of application Ser. No. 854,763 filed Apr. 23, 1986.

BACKGROUND OF THE INVENTION

This invention relates to a container type toilet implement for containing liquid toilet article such as, for example, an eyebrow pencil or a liquid lipstick or rounge in a container to sufficiently supply the article to the tip of a brush provided at the end of the container by operating a pumping mechanism provided in the container.

A conventional toilet implement using liquid toilet lotion is constructed to clamp a cap integrally extending from a brush tip retaining shaft with a container for containing the liquid toilet lotion. This structure impregnates the lotion in the container with the brush tip formed at the end of the tip retaining shaft. Thus, when making up a face with the implement, a cap is removed from the container, the cap is used as a grasping member, and the lotion impregnated at the brush tip is coated on the face.

In the conventional toilet implement described above, when the liquid lotion is impregnated with the brush tip, it is necessary to insert the tip into the container at every makeup time thus causing application of the makeup to be complicated. Further, when the cap is removed from the container at using time the container is feasibly overturned to leak the lotion in the container. Then, since the brush tip is directly dipped in the liquid lotion, it is difficult to prevent the liquid lotion from dropping from the tip.

SUMMARY OF THE INVENTION

Accordingly, it is an object of this invention to provide a container type toilet implement which can eliminate the abovementioned disadvantages of the conventional toilet implement and can prevent the liquid lotion from leaking.

According to this invention, there is provided a container type toilet implement which comprises a container body formed liquidtightly with an elevationally movable bottom cover at the bottom, a pumping mechanism projected upwardly from the neck of the container, a brush shaft integrally formed with the pumping mechanism, a brush tip mounted at the tip retaining shaft, and a cylindrical core provided to communicate the tip and the pumping mechanism through the core to feed the liquid fed by the pumping mechanism to the tip. Thus, when making up a face, the toilet lotion is supplied by the pumping mechanism to the brush tip, and the lotion is supplied to the tip by the pumping mechanism, thereby eliminating the possibility of leaking the lotion and overturning of the container.

The foregoing object and other objects as well as the characteristic features of the invention will become more fully apparent and more readily understandable by the following description and the appended claims when read in conjunction with the accompanying drawings.

DESCRIPTION OF THE PREFERRED EMBODIMENTS

An embodiment of this invention will be described in detail with reference to the accompanying drawings.

Figure 1:
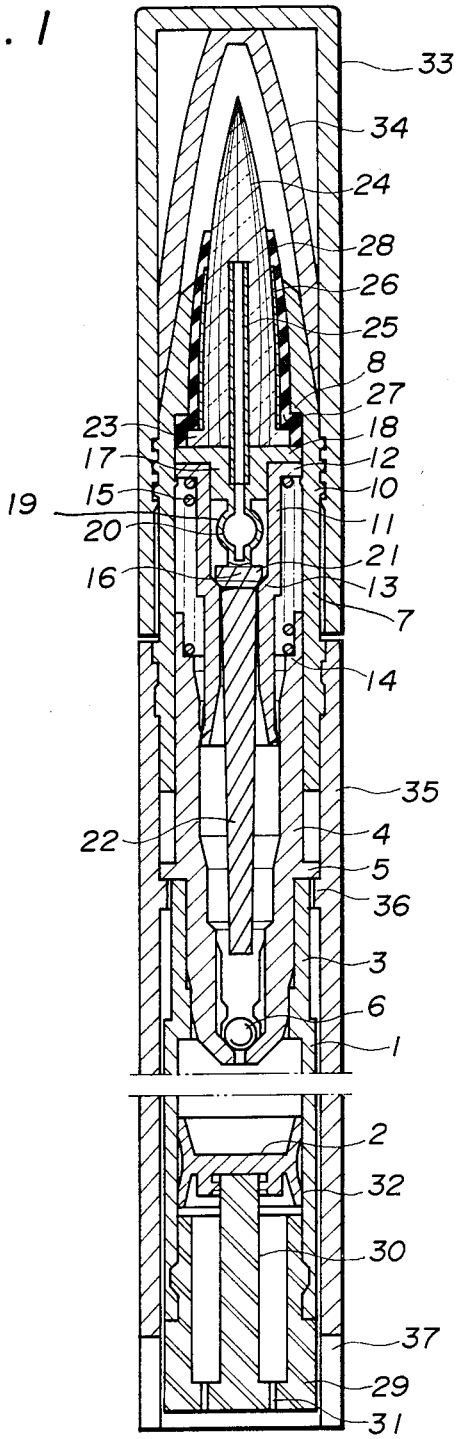
FIG. 1 is a longitudinal fragmentary sectional view of a first embodiment of a container type toilet implement according to this invention.

FIG. 1 shows a first embodiment of a container type toilet implement according to this invention.

The container type toilet implement of this invention comprises a container body 1 for containing liquid toilet article, and an elevationally movable bottom cover 2 is liquidtightly provided at the bottom of the body 1.

A cylinder 4 of a pumping mechanism is projected from a neck 3 of the body 1 to be engaged with the top of the neck 3 by an outward flange 5 formed at the intermediate area of the cylinder. The cylinder 4 is also engaged internally at the lower half portion thereof via rough surfaces to be upwardly projected from the neck 3. A suction valve 6 is internally engaged in the lower portion of the cylinder 4. A cylindrical brush tip retaining shaft 7 is extended upwardly at the lower portion elevationally movably in outer contact with the upper portion.

The tip retaining shaft 7 is formed in a flared shape from its top toward its central portion in such a manner that the upper end is inwardly made in an increased thickness. A dowanward step 8 is formed on the inner surface and threads 10 are formed on the slightly lower outer peripheral surface of the step 8.

A piston 11 to be telescoped with the cylinder 4 of the pumping mechanism is engaged at its lower end in an inner contact with the upper inner surface of the cylinder 4 and fixedly secured at the upper end by an outward flange 12 to the upper inside of the tip retaining shaft 7. An upward step valve seat 13 is formed on the intermediate inner peripheral surface of the piston 11. The piston 11 is energized in a direction separating from the cylinder by a return spring 15 provided between the upper end flange 12 of the piston 11 and the upper end 14 of the cylinder 4.

An exhaust valve member 16 is fixedly secured to and extended from the inner surface of the tip retaining shaft 7 by an outward flange 18 of the upper cylindrical end 17 inside the piston 11. The valve member 16 is so arranged that two elastic plates 19 extend at a predetermined interval from the lower surface of the upper cylindrical end 17, and formed with a central bent portion 20 in the intermediate area of the elastic plates 9 in an opposed manner in a ring shape. An outward flange valve body 21 is formed to be contacted under pressure with the valve seat 13 of the piston 11 at the lower part of the bent portion 20, and a valve rod 22 extending into the cylinder 4 is formed at the lower portion of the valve body 21. The valve rod 22 regulates the inner volume of the cylinder 4 and presses the suction valve 6 at the lower end to forcibly return at returning time.

A brush tip 24 formed at its lower end in a flange 23 solidified by thermal fusion-bonding with an adhesive is mounted at the end of the tip retaining shaft 7. An inner hollow cylindrical core 25 for feeding liquid communicating with the upper cylindrical end 17 of the valve member 16 is disposed at the rear end extending from the end to substantially intermediate position of the brush tip 24 in the vicinity of the inner center of the tip 24. A metallic cylinder 26 is coated on the lower outer half periphery of the tip 24, and a rubber cylinder 28 engaged at the lower large-diameter portion 27 between the flange 23 and the lower step 8 of the tip retaining shaft is engaged between the metallic cylinder 26 and the tip retaining shaft 7. The cylindrical core 25, the metallic cylinder 26 and the rubber cylinder 28 are disposed so that the opening end of the core 25 is disposed above the metallic cylinder 26 and the tip of the rubber cylinder 28 is disposed above the opening end of the core 25.

A pushbutton 29 for pressing is secured and projected downwardly from the lower end opening of the container body 1. The pushbutton 29 is formed with an erected tip retaining shaft 30 at the center, and an air vent opening 31. The bottom cover 2 is formed at the peripheral edge in an arcuate sectional shape of the elastic peripheral wall 32 so that the wall 32 is contacted with the inner surface of the container body 1 and engaged liquidtightly to be elevationally movable.

A cap 33 is engaged with the outside of the tip retaining shaft 7. An inner cap 34 is engaged fixedly within the cap 33 so that the inner peripheral end is hermetically engaged with the outer periphery of the end of the tip retaining shaft 7, thereby preventing the brush tip from drying.

Reference numeral 35 designates an outer cylinder engaged at its upper end with the lower outer surface of the tip retaining shaft 7. The outer cylinder 35 is formed with an inward flange 36 for engaging the outward flange 5 of the cylinder 4 on the upper inner peripheral surface to form a narrow gap to the outer surface of the body 1. A recess 37 is formed at the lower end side of the cylinder 35, and the pushbutton 29 is pressed into the recess 37. The respective members except the metallic cylinder 26, the rubber cylinder 28 and the return spring 15 are molded of synthetic resin.

The operation of the container type toilet implement thus constructed as described above will be described. The cylinder 4 is normally biased downward by return spring 15 so that the outer cylinder 35, the tip retaining shaft 7, the piston member 11 and the valve member 16 (all of which are interconnected) are normally lifted to the upper limit by the return spring 15, and toilet solution or lotion sucked by the suction valve 6 is filled in the cylinder 4.

When making up a face, the cap 33 is first removed, and the container body and the cylinder (4 which are interconnected) are lifted together by the pushbutton 29 against the return spring 15 until the flange 5 of the cylinder 4 abuts the base of the tip retaining shaft 7 (or the outer cylinder 35, the tip retaining shaft 7, the piston member 11 and the valve body 16 are pressed down). Then, the lotion in the cylinder 4 is pressurized by upward movement of the cylinder 4 and body 1, and the pressurized lotion presses the valve rod 22 upwardly to lift upward the lower portion of the elastic compression plates 19 and distort the bent portions 20 to open the exhaust valve 12. Thus, the lotion is fed through the compression plates 19 to the core 25 for feeding the lotion, and then supplied to the brush tip 24. The interior of the cylinder 4 is evacuated in negative pressure by the supply of the lotion, the suction valve 6 is thus opened to suck the lotion into the cylinder 4 in the container body 1, and the bottom cover 2 is moved upward in response to the opening of the suction valve 6.

The rubber cylinder 28 is coated to the vicinity of the brush tip 24 on the other surface of the tip, thereby preventing the brush hairs of the tip from scattering at the top. Further, the core 25 is projected from the metallic cylinder 26 to the brush tip side, and even if the metallic cylinder 26 is collapsed to flatten the brush tip, the lotion passage is not blocked.

Figure 2:
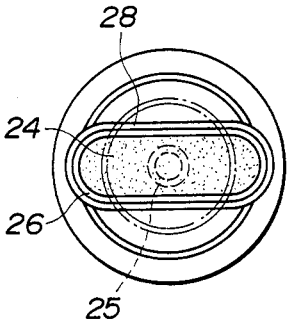
FIG. 2 is a lateral sectional view of the toilet implement.

FIG. 2 shows the brush tip 28 of round cross section flattened by collapsing the upper end exposed externally of the metallic cylinder 26.

Figure 3:
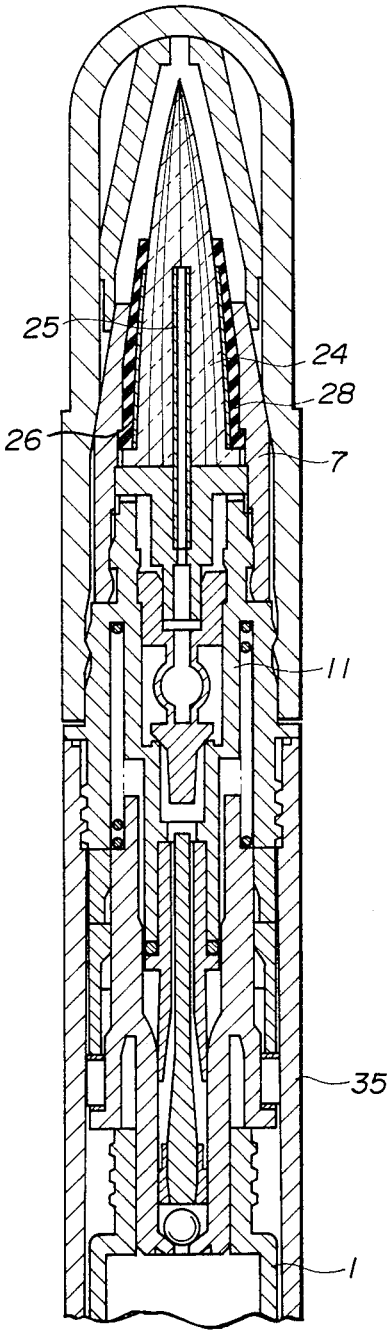
FIG. 3 is a longitudinal fragmentary sectional view of a second embodiment of the invention.

FIG. 3 shows a second embodiment of the brush tip of the container type toilet implement according to this invention. The tip retaining shaft 7 is engaged with the brush tip 24, the metallic cylinder 26 and the rubber cylinder 28. The tip retainer shaft is detachably engaged with the top of the double cylinder piston member 11 having inner and outer piston cylinders. The outer piston cylinder is engaged with the upper inside end of the outer cylinder 35 surrounding the outside of the body 1. Thus, the shaft 7, the tip 24, the core 25, the metallic cylinder 26 and the rubber cylinder 28 may be detachably engaged as a unit with this structure. Thus, the brush tip 24 can be replaced.

Figure 4:
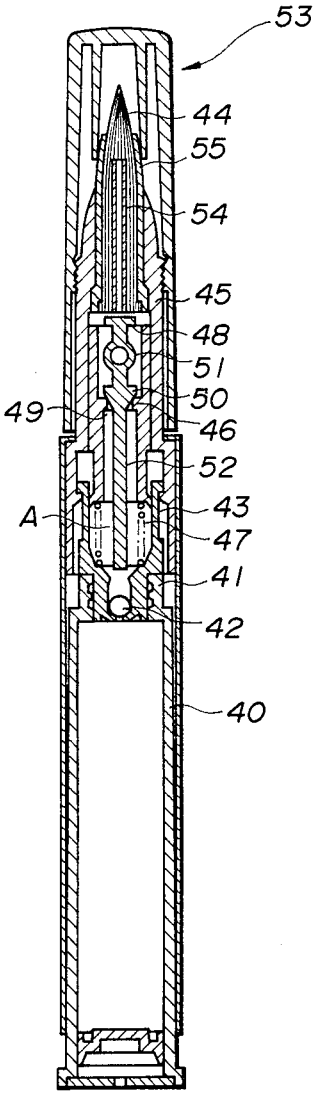
FIG. 4 is a longitudinal fragmentary sectional view of a third embodiment of the invention.

FIG. 4 shows a third embodiment of the container type toilet implement according to this invention.

The toilet implement of this embodiment comprises a valve cylinder having a cylindrical neck member 43 internally engaged with a suction valve 42 at the lower end, projected from the interior upwardly from the neck 41 of the container body 40, a brush tip retaining shaft 45 mounted with the brush tip 44 in the opening end, and a neck member 43 always energized upward at the lower half portion by a return spring 47 mounted around the engaging projection 52 for a valve on the inner periphery, extending upward in a liquidtight manner and elevationally movable manner with the neck member 43 by the tip retaining shaft 45, secured to the tip retaining shaft 45 to form a storage chamber A, and a cap 53 having an engaging projection 50 for forming an exhaust valve 49 to be bonded upwardly from the engaging projection 46 on the intermediate outer surface, drooped downward from the tip retaining shaft core of the storage chamber A secured to the inner periphery of the tip retining shaft 45 through the upper outward flange 48 formed with a passage communicating with the tip 44 and formed at the upper end with a ring-shaped elastic portion 51, a valve tip retaining shaft 52 elevationally movable at the lower end of the elastic portion 51, engaged with the outer surface of the tip retaining shaft 45.

A cylindrical core 54 is internally formed to supply toilet lotion to the brush tip in the same manner as the previous embodiments in the vicinity of the inner center of the tip 44 to communicate at the lower end of the core with the valve tip retaining shaft 52. The brush tip retaining member 55 extended from the end to the vicinity of the tip is engaged with the outer periphery of the tip, and the retaining member 55 is interposed between the tip retaining shaft 45 and the tip.

According to this invention as described above, the container type toilet implement comprises the pumping mechanism having the container body, the cylinder member and the piston member in such a manner that the toilet lotion is supplied to the brush tip by the pumping mechanism. Thus, the lotion may not be leaked externally, and the lotion can be readily supplied to the brush tip. Further, the rubber cylinder or the tip retaining member is coated on the outer surface to the vicinity of the tip, thereby preventing the brush hairs from scattering.

What is claimed is:

1. A container type toilet implement comprising:

a container body defining upper and lower ends, a neck of the container body being located in the upper end of the container body;

a cylinder projected upwardly from the neck of said container body;

a piston mechanism engaged at a lower portion thereof with an inner surface of said cylinder, said cylinder being disposed slidably and telescopically about said piston mechanism;

a bottom cover elevationally movable in the lower end of said container body for operating said cylinder relative to said piston mechanism;

an exhaust valve member provided in said piston mechanism and extending into said cylinder, said exhaust valve member providing selective output from said cylinder;

a brush tip retaining shaft engaged with said piston mechanism;

a brush tip mounted on the brush tip retaining shaft;

an inner hollow cylindrical core disposed in the brush tip and extending toward said exhaust valve member for providing communication between said brush tip and the exhaust valve member;

at least one brush tip retaining member located on a portion of the outer periphery of the brush tip, said at least one brush tip retaining member exposing only a tip end of said brush tip.

2. The container type toilet implement according to claim 1, wherein a metallic cylinder is located on a part of the outer periphery of said brush tip inside said brush tip retaining member.

3. The container type toilet implement according to claim 2, wherein one end of said inner hollow cylindrical core is disposed above said metallic cylinder, and an end of said at least one brush tip retaining member is disposed above the one end of said cylindrical core.

4. The container type toilet implement according to claim 1, wherein said at least one tip retaining member is a rubber cylinder.

5. The container type toilet implement according to claim 2, wherin a lower end of said brush tip is formed into a flange, and said flange is engaged with a lower end step of said at least one brush tip retaining member, the lower end step of said at least one brush tip retaining member being engaged with a corresponding step at an upper inside surface of said brush tip retaining shaft.

6. The container type toilet implement according to claim 2, wherein said brush tip retaining shaft is engaged integrally as a unit with the brush tip, the inner hollow cylindrical core, the metallic cylinder and brush tip retaining member, said unit being detachable from said piston mechanism.

7. The container type toilet implement according to claim 1, wherein a cap is mounted on an outer periphery of said tip retaining shaft, an inner cap is formed in a cap, and the lower inner peripheral end of the inner cap is closely contacted with an outer peripheral end of said tip retaining shaft.

8. A container type toilet implement comprising:

a container body defining upper and lower ends, a neck of the container body being located at the upper end of the container body;

a cylinder projected upwardly from the neck of said container body and having a top end;

a suction valve internally mounted at a bottom of said cylinder;

a cylindrical tip retaining shaft provided at the top end of said cylinder;

a piston having a flange internally provided at the top end of said cylinder, said piston being secured at an upper end thereof to an inner surface of said tip retaining shaft and formed with an upward step shaped valve seat on an intermediate inner periphery of said piston, said cylinder being disposed slidably and telescopically about said piston;

a return spring disposed between the flange of said piston and the top end of said cylinder;

an exhaust valve member disposed inside said piston and secured to said tip retaining shaft by an outward flange;

said exhaust valve member having two elastic plates extending at a predetermined interval from a lower surface of said outward flange, each elastic plate having a bent portion opposed in a ring shape in an intermediate area of said elastic plates, said exhaust valve member further including a valve body contacted under pressure with the valve seat of said piston and located at a lower part of said bent portion, said valve body having a lower end extending into the cylinder;

a brush tip engaged with said tip retaining shaft;

an inner hollow cylindrical core disposed in the brush tip for providing communication between said brush tip and said exhaust valve member;

a metallic cylinder formed on an outer periphery of said brush tip;

a brush tip retaining member interposed between said metallic cylinder and said tip retaining shaft on the outer periphery of said brush tip; and one end of said inner hollow cylindrical core being disposed above an end of said metallic cylinder, and an end of said tip retaining member being disposed above the one end of said inner hollow cylindrical core.

* * * * *